US006838221B2

(12) United States Patent
Ito et al.

(10) Patent No.: US 6,838,221 B2
(45) Date of Patent: Jan. 4, 2005

(54) CONTINUOUS CRUSHING METHOD AND APPARATUS

(75) Inventors: Tomiaki Ito, Tagata-gun (JP); Hidehiro Mochizuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 10/183,400

(22) Filed: Jun. 28, 2002

(65) Prior Publication Data

US 2003/0022091 A1 Jan. 30, 2003

(30) Foreign Application Priority Data

Jul. 6, 2001 (JP) ..... 2001-205840

(51) Int. Cl.[7] ..... G03G 9/08
(52) U.S. Cl. ..... 430/137.18; 241/30
(58) Field of Search ..... 430/137.18, 137.2; 241/30, 186.5

(56) References Cited

FOREIGN PATENT DOCUMENTS

JP 06-273978 * 9/1994

OTHER PUBLICATIONS

Japanese Patent Office Machine–Assisted Translation of JP 06–273978 (Pub Sep. 1994).*
U.S. Appl. No. 09/809,981, filed Mar. 16, 2001.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A continuous crushing method including at least feeding a toner block into a crusher through a screw feeder thereof having a crushing capacity while cyclically increasing and decreasing a feeding amount of the toner block; and crushing the toner block to prepare a toner, in which the feeding amount of the toner block in the increasing cycle is larger than the crushing capacity.

9 Claims, 4 Drawing Sheets

CONTINUOUS CRUSHING METHOD AND APPARATUS

BACKGROUND OF THE INVENTION

1. Field of the Invention

The present invention relates to a continuous crushing method and apparatus, and more particularly to an improved continuous crushing method and apparatus for producing a toner having a low softening point and a small particle diameter, which is preferably used for developing an electrostatic latent image; and a toner having a uniform particle size distribution.

2. Discussion of the Background

Conventionally, a method of producing coarse toner particles having a volume-average particle diameter not greater than 40 μm is so-called a batch method in which a fed amount of a block material to be crushed is same as that of the material crushed. However, the batch method has quite a low productivity because a crushable amount at a time is limited in the batch method. In addition, in order to improve the productivity, an experiment has to be performed to find the crushable amount at a time, i.e., a condition in which the material is not melted by a heat, and it takes time to find an optimum amount.

In the batch method, a toner being crushed is softened by a heat and the following phenomena are observed.

Namely, a toner which is continuously crushed for a long time is melted and has a serious problem in its quality. This problem is avoidable by reducing the fed amount of the material crushed at a time. However, when the fed amount is quickly reduced, the particle sizes of the toner become different with time. Namely, after the crushing is started, in the first half of the long-time continuous crushing, there is a tendency in which a rate of finely powdered toner is large and a rate of coarsely powdered toner is small. To the contrary, it is well known that in the second half of the long-time continuous crushing, a rate of finely powdered toner is small and a rate of coarsely powdered toner is large.

Therefore, the particle size distribution of the toner fed to the next process, i.e., a pulverizing and classifying process, is different with time and such a difference causes a serious quality problem of the toner.

As a matter of course, a continuous crushing method which has by far higher productivity than the batch method is studied, but is not satisfactory yet. In particular, a satisfactory crushing method is not found yet for a toner including an inorganic pigment, which is difficult to pulverize.

Because of these reasons, a need exists for a continuous crushing method and apparatus in which a toner does not melt and deteriorate the quality thereof even when continuously crushed for a long time.

SUMMARY OF THE INVENTION

Accordingly, an object of the present invention is to provide a continuous crushing method and apparatus, in which a toner does not melt and deteriorate the quality thereof even when continuously crushed for a long time. In addition, another object of the present invention is to provide a continuous crushing method having by far higher productivity than the batch method as well as capability to prevent the toner from melting.

Briefly these objects and other objects of the present invention as hereinafter will become more readily apparent can be attained by a continuous crushing method of producing coarse toner particles having a volume-average particle diameter not greater than 40 μm, in which a fed amount of a toner block is cyclically decreased and increased, and in which the increased amount thereof is larger than a crushable amount of a crusher at a time and the toner block is stably crushed even when crushed excessively long.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides a method of crushing a toner block, having high productivity, in which the toner melting due to a heat generated in crushing and irregularities of particle diameter distribution of the toner can be prevented by modifying a method of feeding a toner block. In addition, capacity of a crusher having small crushing capacity can be improved and a space can be saved.

In embodiments, the present invention provides a continuous crushing method comprising: feeding a toner block into a crusher through a screw feeder thereof having a crushing capacity while cyclically increasing and decreasing a feeding amount of the toner block; and crushing the toner block to prepare a toner, wherein the feeding amount of the toner block in the increasing cycle is larger than the crushing capacity. The toner can have a volume-average particle diameter not greater than 40 μm. The feeding step can further comprise controlling the feeding amount by a twin timer. The feeding step can further comprise changing a revolution speed of the screw feeder to cyclically increase and decrease the feeding amount of the toner block.

In other embodiments, the present invention provides a continuous crushing method comprising: intermittently feeding a toner block into a crusher through a screw feeder thereof having a crushing capacity while repeating a feeding operation and a non-feeding operation; and crushing the toner block to prepare a toner, wherein a feeding amount of the toner block in the feeding operation is larger than the crushing capacity. The toner can have a volume-average particle diameter not greater than 40 $\mu$m. The toner block can be fed into the screw feeder when the toner block does not exist in the crusher. The feeding step can further comprise controlling the feeding amount by a twin timer. The feeding step can further comprise changing a revolution speed of the screw feeder to intermittently feed the toner block.

Hereinafter, preferred embodiments of a method of producing a dry toner for developing an electrostatic latent image in an electrophotography, an electrostatic recording and an electrostatic printing will be explained based on the drawings.

Figure 1:
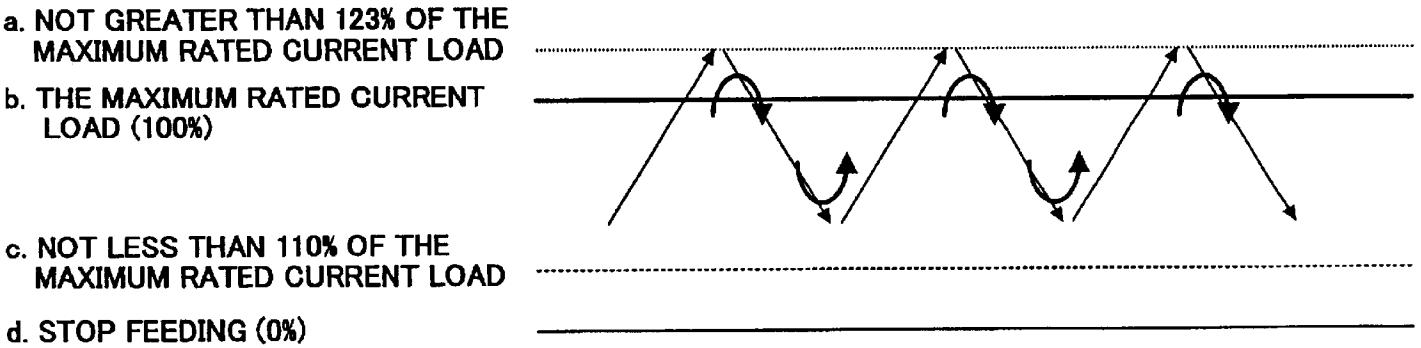
FIG. 1 is a diagram showing a principle of an embodiment of the method of feeding a toner block (a cycle method) of the present invention.

FIG. 1 is an embodiment of the crushing method of the present invention. In FIG. 1, b represents a conventional rated current load in continuous feeding. In the present invention, there is a feeding cycle of a, b and c. When the current is a (not greater than 123% of the maximum rated current of a motor), the toner block is fed more than when the current is the rated current b. When the current is c (not less than 110% of the minimum rated current), the toner block is fed within a range not coming to stoppage of feeding d.

In principle, within a range of a, b and c, a fed amount of a toner block is cyclically decreased and increased. This method prevents a toner from melting due to a heat generated in crushing and irregularities of the particle diameter distribution of the toner. As for the supplied current, there is a fear that the toner is melted by a heat generated by the current which is 123% of the maximum rated current. However, the toner block can have a surface temperature not greater than 43° C. by the cycle method, even though the toner block conventionally begins to melt when having a surface temperature not less than 58° C. in the same amount as that of the cycle method.

Figure 2:
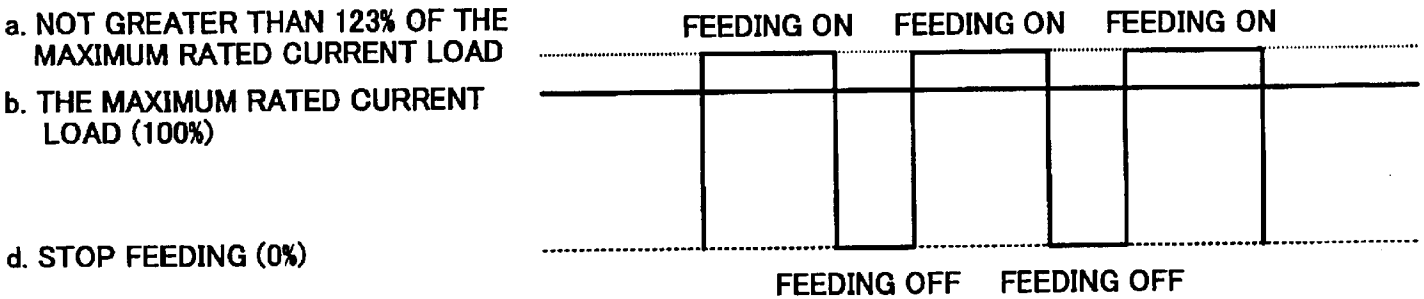
FIG. 2 is a diagram showing a principle of another embodiment of the method of feeding a toner block (an intermittent method) of the present invention.

FIG. 2 is another embodiment of the crushing method of the present invention. In FIG. 2, a is the same as that of FIG. 1. In principle, this is an intermittent feeding method in which the toner block is fed in a range of a (ON) and feeding of the toner block is stopped in a range of d (OFF). This method also prevents a toner from melting due to a heat generated in crushing and irregularities of the particle diameter distribution of the toner. Specifically, ON and OFF of the toner block feeding can be freely adjusted according to a relationship between a residual toner block amount in a crusher and a hammer current load.

Figure 3:
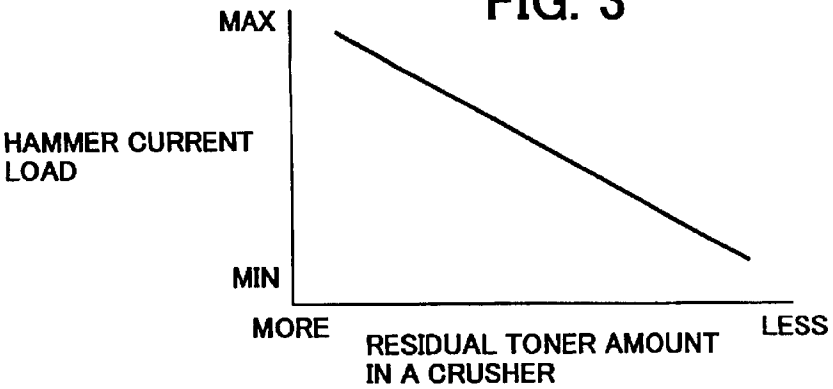
FIG. 3 is a diagram showing a relationship between a residual toner block amount in a crusher and a hammer current load of the present invention.

FIG. 3 is a diagram showing a relationship between a residual toner block amount in a crusher and a hammer current load. It is apparent in this diagram that the less the residual toner block amount in a crusher, the less the hammer current load. To the contrary, the more the residual toner block amount in a crusher, the more the hammer current load.

Figure 4:
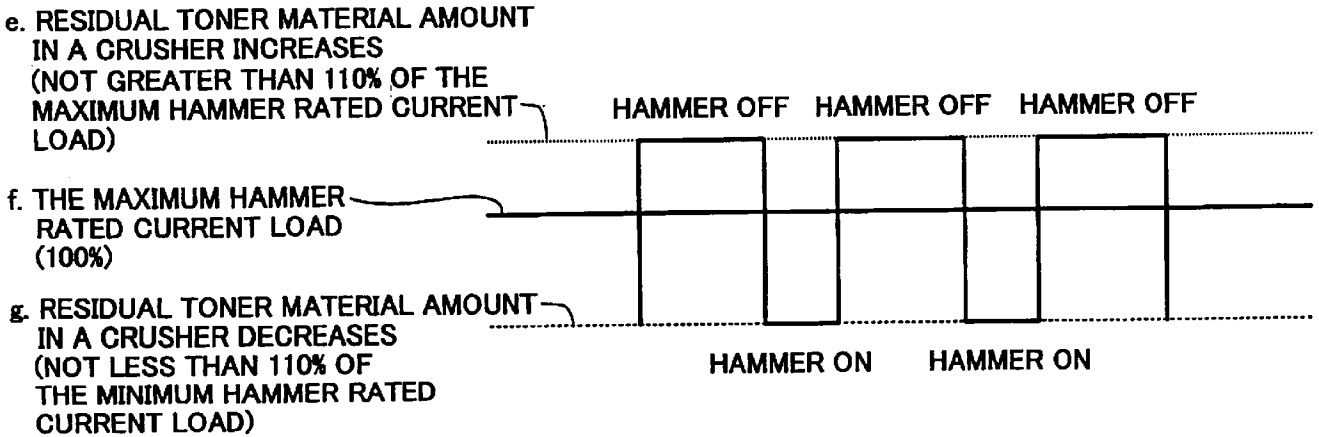
FIG. 4 is a diagram showing a principle of an intermittent feeding of a toner block of the present invention, using a twin timer.

FIG. 4 is an embodiment of a feeding principle using the above-mentioned relationship. This is an intermittent feeding method in which feeding starts (ON) after detecting the hammer current load in idling and feeding is stopped (OFF) after detecting the hammer current load not greater than 110% of the maximum rated current load of the hammer. This method also prevents a toner from melting due to a heat generated in crushing and irregularities of the particle diameter distribution of the toner.

As FIG. 4 shows, when the ON and OFF can be periodically controlled by a twin timer in which predetermined conditions such as a period of time and a temperature are set, feeding can be stably performed without detecting the hammer current load in idling and the maximum hammer current load. This method also prevents a toner from melting due to a heat generated in crushing and irregularities of the particle diameter distribution of the toner. In addition, a screw feeder can feed a fixed amount of the toner block by a change of the revolution speed.

Next, a crusher using the crushing method of the present invention will be explained.

Figure 5:
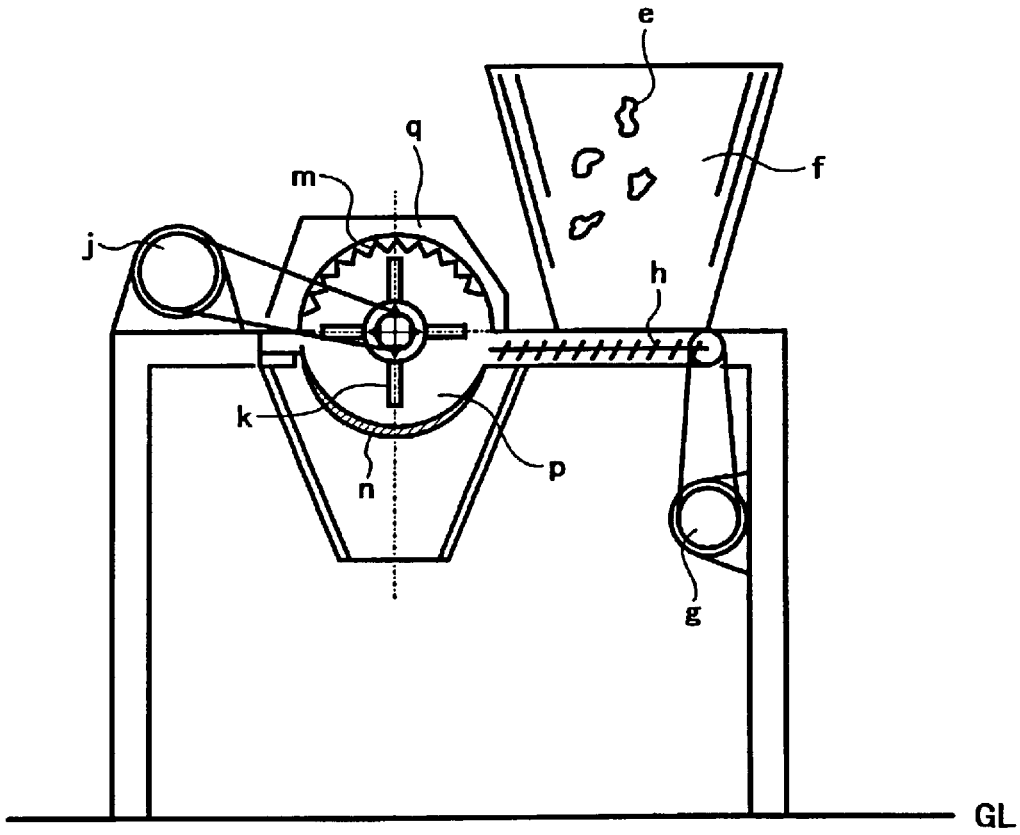
FIG. 5 is a schematic view illustrating an embodiment of a crusher of the present invention, having a liner and a flat plate hammer.

FIG. 5 is an embodiment of a crusher having a liner and a flat plate hammer.

As FIG. 5 shows, a toner block e is transferred into a crushing chamber p by a feeder h driven by a feeding motor g.

In the crushing chamber p, a flat plate hammer k driven by a motor for rotating a hammer j, which is rotatable at a high speed is formed. The transferred toner block e is crushed by the above-mentioned flat plate hammer k and a liner m formed on a casing q formed above the hammer k.

The crushed toner is screened by a mesh n and coarse particles which cannot pass the mesh is crushed by the above-mentioned crushing operation.

Figure 6:
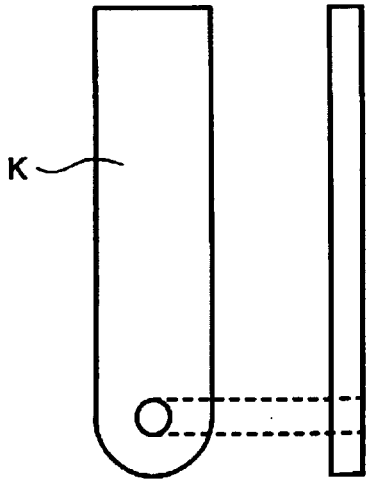
FIG. 6 is a schematic view illustrating a cross section of the flat plate hammer of the present invention.

FIG. 6 is a schematic view illustrating a cross section of the flat plate hammer k. When a tip of the hammer k is sharpened, the crushing efficiency is improved and coarse particles dramatically decrease.

When the tip of the hammer k is coated with a Stellite or SKH abrasion resistant material upon application of heat, the abrasion resistance thereof is 3.8 times as good as that of a conventional SUS-lined hammer.

Figure 7:
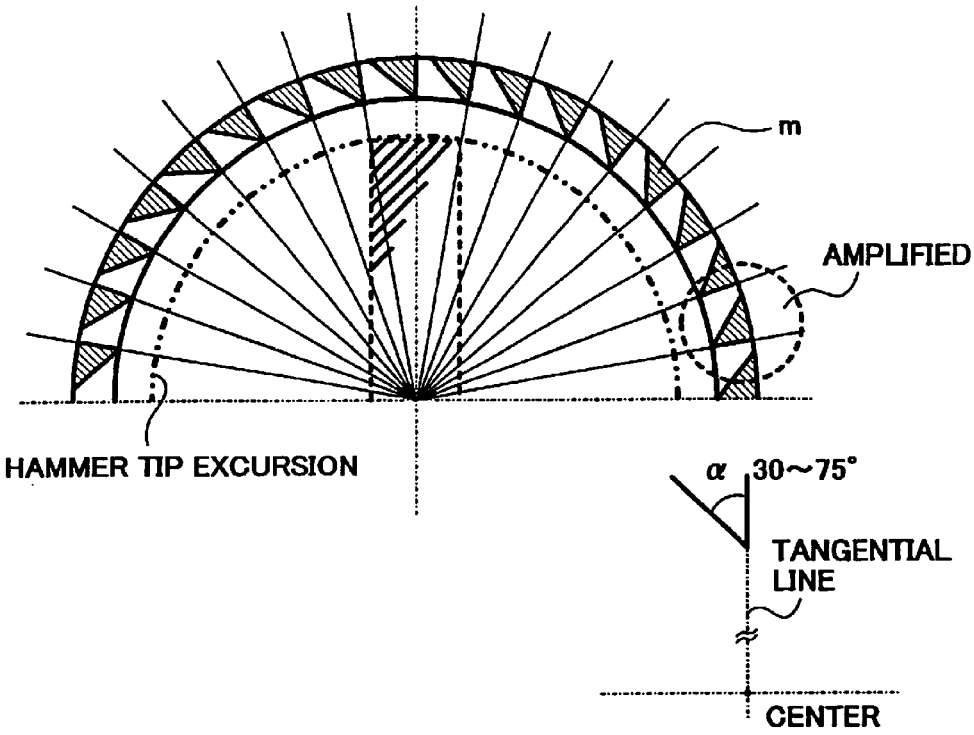
FIG. 7 is a schematic view illustrating a cross section of the liner of the present invention.

FIG. 7 is a schematic view illustrating a cross section of the liner m. In FIG. 7, $\alpha$ is an angle formed by a side of a protrusion of the liner m and the other side thereof. When the angle $\alpha$ is 45°, the toner has a surface temperature not greater than 50° C. and does not melt. When 25°, the toner melts due to a heat. When 80°, the toner has a lower surface temperature than when 45° but the crushing efficiency deteriorates.

Therefore, the protrusion of the liner m preferably has an angle a of from 30 to 75°.

In addition, the protrusion of the liner m can be detachable. The detachable protrusion can shorten cleaning time, and further the liner m can be easily exchanged when the temperature increases to produce a toner having good quality.

Furthermore, when a thickness gauge is arranged between the detachable liner m and the casing q and a distance between the hammer k and the liner m can be optionally adjusted to control the increase of the temperature and the particle diameter of the toner.

Figure 8:
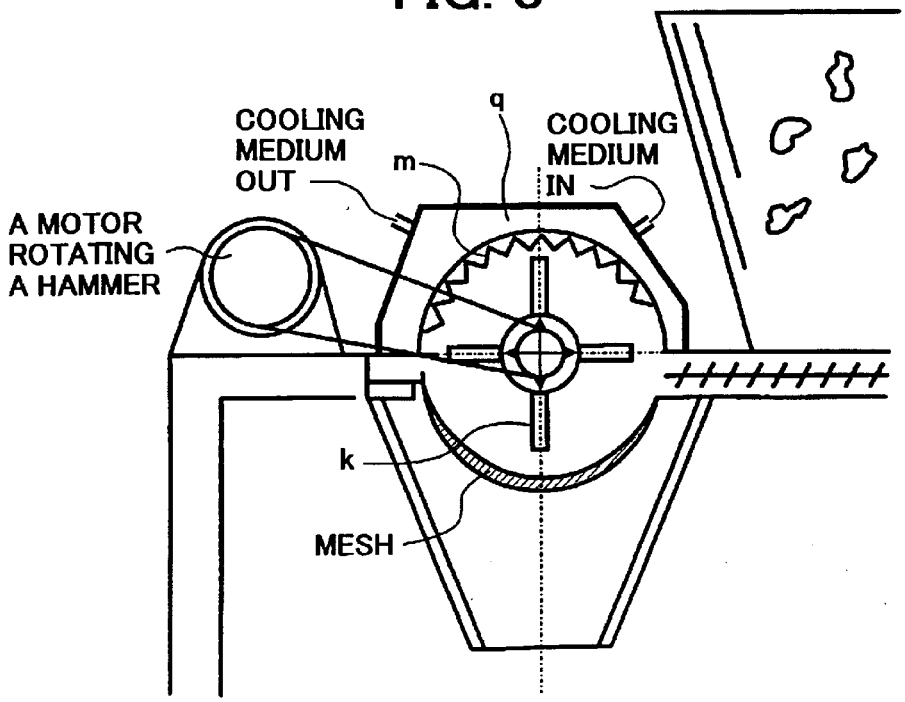
FIG. 8 is a schematic view illustrating an embodiment of a casing portion having a cooling jacket of the present invention.

FIG. 8 is a schematic view illustrating an embodiment of a casing q having a cooling jacket. As FIG. 8 shows, when the casing q having the liner m has the cooling jacket, a long-time continuous crushing operation can be performed in addition to controlling the increase of the temperature.

The toner block used in the present invention is the following materials conventionally used to produce a toner.

| | |
|---|---|
| (1) Styrene-acrylic copolymer | 100 parts by weight |
| (2) Carbon black | 10 parts by weight |
| (3) Polypropylene | 5 parts by weight |
| (4) Zinc salicylate | 2 parts by weight |

The above-mentioned embodiments of the present invention are provided for the purpose of illustration only and are not intended to be limiting.

This document claims priority and contains subject matter related to Japanese Patent Application No. 2001-205840 filed on Jul. 6, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A continuous crushing method comprising:

feeding a toner block into a crusher through a screw feeder thereof having a crushing capacity while cyclically increasing and decreasing a feeding amount of the toner block; and crushing the toner block to prepare a toner, wherein the feeding amount of the toner block in the increasing cycle is larger than the crushing capacity.

2. The continuous crushing method of claim 1, wherein the toner has a volume-average particle diameter not greater than 40 $\mu$m.

3. The continuous crushing method of claim 1, wherein the feeding step further comprises controlling the feeding amount by a twin timer.

4. The continuous crushing method of claim 1, wherein the feeding step further comprises changing a revolution speed of the screw feed to cyclically increase and decrease the feeding amount of the toner block.

5. A continuous crushing method comprising:

intermittently feeding a toner block into a crusher through a screw feed thereof having a crushing capacity while repeating a feeding operation and a non-feeding operation; and crushing the toner block to prepare a toner, wherein a feeding amount of the toner block in the feeding operation is larger than the crushing capacity.

6. The continuous crushing method of claim 5, wherein the toner has a volume-average particle diameter not greater than 40 $\mu$m.

7. The continuous crushing method of claim 5, wherein the toner block is fed into the screw feeder when the toner block does not exist in the crusher.

8. The continuous crushing method of claim 5, wherein the feeding step further comprises controlling the feeding amount by a twin timer.

9. The continuous crushing method of claim 5, wherein the feeding step further comprises changing a revolution speed of the screw feeder to intermittently feed the toner block.

* * * * *